US007893390B2

(12) United States Patent
Fisch et al.

(10) Patent No.: US 7,893,390 B2
(45) Date of Patent: Feb. 22, 2011

(54) GUIDED MISSILE

(75) Inventors: Peter Gerd Fisch, Überlingen (DE); Michael Gross, Salem (DE)

(73) Assignee: Diehl BGT Defence GmbH & Co. KG, Ueberlingen (DE)

( * ) Notice: Subject to any disclaimer, the term of this patent is extended or adjusted under 35 U.S.C. 154(b) by 0 days.

(21) Appl. No.: 12/402,523

(22) Filed: Mar. 12, 2009

(65) Prior Publication Data

US 2009/0230234 A1 Sep. 17, 2009

(30) Foreign Application Priority Data

Mar. 13, 2008 (DE) ..... 10 2008 014 257

(51) Int. Cl.
*B64C 1/00* (2006.01)
*F42B 15/00* (2006.01)
*B64G 1/22* (2006.01)
*F41G 7/00* (2006.01)

(52) U.S. Cl. ..... 244/3.1; 244/3.11; 244/3.15; 244/158.1; 244/117 R; 244/118.1; 89/1.11; 701/200; 701/207; 701/213; 342/1; 342/5; 342/13

(58) Field of Classification Search ..... 244/3.1–3.3, 244/1 R, 158.1, 117 R, 118.1; 89/1.11; 342/1–13; 102/306–308, 475, 476, 492; 701/200, 207, 701/213–216
See application file for complete search history.

(56) References Cited

U.S. PATENT DOCUMENTS 4,142,695 A * 3/1979 Remmell et al. ..... 244/3.14
4,296,894 A * 10/1981 Schnabele et al. ..... 244/3.27
4,364,530 A * 12/1982 Ripley-Lotee et al. ..... 244/3.22
4,623,106 A * 11/1986 Price et al. ..... 244/3.1
4,892,268 A 1/1990 Peretti et al.
4,899,956 A * 2/1990 King et al. ..... 244/3.21
5,211,356 A * 5/1993 McWilliams et al. ..... 244/3.15
5,267,885 A * 12/1993 Niskern et al. ..... 244/3.24
5,379,968 A * 1/1995 Grosso ..... 244/3.21
5,425,514 A * 6/1995 Grosso ..... 244/3.22
5,615,846 A * 4/1997 Shmoldas et al. ..... 244/3.28
6,056,237 A * 5/2000 Woodland ..... 244/3.15
6,462,322 B1 10/2002 Gauggel et al.
6,494,140 B1 * 12/2002 Webster ..... 244/3.11

FOREIGN PATENT DOCUMENTS

CH 376031 A 3/1964
DE 3826702 A1 2/1990
DE 3917111 A1 11/1990
DE 3934834 C2 10/1991
DE 19828645 C1 11/1999
DE 102005042484 A1 3/2007
GB 845144 A 8/1960
GB 2232748 A 12/1990

* cited by examiner

*Primary Examiner*—Bernarr E Gregory
(74) *Attorney, Agent, or Firm*—Laurence A. Greenberg; Werner H. Stemer; Ralph E. Locher

(57) ABSTRACT

A guided missile has a sensor unit, a propulsion unit, and a payload unit. A missile casing forms the outer contour, extends along a longitudinal direction, and accommodates the sensor unit, the propulsion unit, and the payload unit. At least two of the units can be fitted alongside one another in the longitudinal direction. In comparison to conventional guided missiles, the guided missile is distinguished by increased modularity and thus by increased flexibility with regard to different operational scenarios.

26 Claims, 2 Drawing Sheets

GUIDED MISSILE

CROSS-REFERENCE TO RELATED APPLICATION

This application claims the priority, under 35 U.S.C. §119, of German application DE 10 2008 014 257.3, filed Mar. 13, 2008; the prior application is herewith incorporated by reference in its entirety.

BACKGROUND OF THE INVENTION

Field of the Invention

The invention relates to a guided missile which is equipped with a sensor unit, with a propulsion unit, and with a payload unit.

A guided missile is typically assembled from a number of different prefabricated units. The various units, each of which have specific associated functions, are in this case each produced—in some cases by different manufacturers—as separate fuselage sections, which are assembled to form the final guided missile only during final assembly. By way of example, the sensor or target seeker unit, possibly with control electronics, the propulsion unit and the payload unit, which is fitted with an active system such as an explosive charge, are manufactured as such separate fuselage sections. The fuselage sections which represent these units are generally joined together using suitable coupling means, during final assembly. This construction also allows relatively older guided missiles to be modernized in a known manner by replacement with individual ones of these units.

SUMMARY OF THE INVENTION

It is accordingly an object of the invention to provide a guided missile, which overcomes the above-mentioned disadvantages of the heretofore-known devices and methods of this general type and which allows adaptation that is as flexible as possible to currently required operational conditions.

With the foregoing and other objects in view there is provided, in accordance with the invention, a guided missile, comprising:

a missile casing defining an outer contour of the missile and extending along a longitudinal direction;

a plurality of units accommodated in said missile casing, said units including a sensor unit, a propulsion unit, and a payload unit;

wherein said missile casing is configured to accommodate at least two of said units fitted alongside one another in the longitudinal direction.

In other words, the above and other objects of the invention are achieved by a guided missile having a sensor unit, having a propulsion unit and having a payload unit, wherein a missile casing which forms the outer contour and extends along a longitudinal direction is provided, and is designed to accommodate the sensor unit, the propulsion unit and the payload unit, in which case at least two of the units can be fitted alongside one another in the longitudinal direction.

In a first step, the invention is based on the idea that it should be possible to replace the sensor unit, the propulsion unit and/or the payload unit by an alternative variant in as short a time as possible in order to comply as optimally as possible with the mission requirements placed on a guided missile.

In a second step, the invention identifies that the previously known construction of a guided missile, according to which the individual units are manufactured as fuselage sections, does not offer this capability. This is because a unit such as this which has been manufactured as a fuselage section can be modified only within tight constraints since, otherwise, this would result in a change to the overall aerodynamic design. In particular, the mass and the overall center of gravity would no longer correspond to the original design data. The requirement for adaptation of the aerodynamics would, de facto, necessitate the design of a new guided missile.

In a third step, the invention is now based on the idea that it is possible to make the guided missile as highly flexible as possible, with regard to its adaptation to widely differing operational scenarios, by departing from the previously normal design of a guided missile composed of individual fuselage sections. This is surprisingly achieved in that a missile casing is provided which forms the outer contour of the guided missile and extends along a longitudinal direction, and which is designed to accommodate the individual units. This measure now makes it possible to design the individual units without being subject to the tight constraints resulting from the aerodynamics of the guided missile. The individual units can be joined together in a specific cargo volume, which is located in the interior of the missile casing, with dimensions and masses that differ on a variant-specific basis, to form an overall arrangement, without this resulting in the need for significant changes to the aerodynamics of the guided missile. If, in this case, at least two of the units can be fitted alongside one another in the longitudinal direction, then the overall center of gravity of the guided missile can be retained even though the individual variants of the respective unit differ from one another in their overall mass and/or in their mass distribution. This is because, for example, the mass of a unit, for example of the payload unit, can be converted to a mass of another unit, for example of the propulsion unit. As a result, both the overall mass of the guided missile and its overall center of gravity remain essentially unchanged, independently of replacement of individual units.

The aerodynamic design of the guided missile therefore remains unchanged. If necessary, any changes to the flying characteristics, resulting from a change in the mass moment of inertia, can easily be compensated for by adaptive regulator settings.

The described guided missile is considerably more modular than a conventional guided missile, and this increased modularity can be assisted in particular by standardized interfaces within the overall system. The specified guided missile can therefore react in a highly flexible manner to different mission requirements and operational scenarios.

The described guided missile which has a high degree of modularity can, in particular, be designed as a lightweight and small guided missile with a length of less than 2 m and with an overall mass of less than about 70 kg. Small missiles such as these are currently generally designed for a tightly constrained operational purpose. Changes in the items fitted lead directly to a redesign with respect to the aerodynamics and the control. The mission profiles cannot be varied with regard to an approach flight that is as intelligent as possible. The propulsion units of such modern guided missiles are designed only for a more or less direct attack on the target. Now, by way of example, the high degree of modularity of the specified guided missile makes it possible to use various active systems as payload units. By way of example, these may be directional and non-directional warheads of different intensity, as well as non-lethal active systems. These active systems are, of course, different with respect to their geometry, mass and center of gravity, as a result of which it has not been possible to replace them in conventional guided missiles.

Furthermore, a lightweight guided missile can possibly also be handled manually if required and can be guided autonomously to the target based on sensors or GPS, exploiting the character of the terrain. The acronym GPS stands for and represents a satellite-based global positioning system. Mission termination or mission modification by the operator can likewise be made possible, even during flight, for example if a better target has been discovered by means of the sensor system in the guided missile or if it is found after firing that there is no point in the attack.

In one advantageous refinement of the invention, the propulsion unit and the payload unit can be fitted alongside one another in the missile casing. This refinement is worthwhile since different active systems frequently have to be used for different operational scenarios or targets. The active systems in this case differ from one another in terms of their geometries and masses. The specific arrangement of the payload unit alongside the propulsion unit makes it possible, however, to integrate the various variants in the guided missile without having to change its overall center of gravity. For example, a correspondingly large warhead is required in order to attack an armoured vehicle. In contrast, non-lethal active means are somewhat smaller and lighter.

If the payload unit is accordingly arranged at the overall center of gravity, then the overall center of gravity position of the guided missile does not change, or changes only insignificantly, as a function of the payload. Effects of the mass differences which are nevertheless present can easily be compensated for, for example by a flight regulator.

Since the propulsion unit generally occupies the majority of the length of a guided missile, the arrangement of the payload unit alongside the propulsion unit furthermore reduces the physical length of the guided missile. Despite having a geometry which is more complex than that of a conventional guided missile, the guided missile described in the present case is physically compact, overall.

The arrangement of the payload unit alongside the propulsion unit furthermore offers the advantage of no interference with the direction of effect. For example, a shaped charge which is used as a payload does not first of all need to penetrate through its own sensor unit or sensor system which, in a conventional guided missile, is arranged in front of the payload unit in the longitudinal direction. In the present case, in contrast, the payload unit is laterally offset with respect to the sensor unit, laterally with respect to the longitudinal direction.

At least one of the units is expediently in the form of an interchangeable module. In this case, the modular design means that the various variants of the respectively provided units can be replaced easily. In particular, in this case, the various variants can be provided with standard electrical and/or mechanical interfaces thus resulting both in easy installation in the guided missile and in easy replacement of two modules. In particular, it is also possible to provide for the modules to be provided with interfaces to one another such that, if required, a plurality of units can also easily be joined together.

The interchangeable modules are preferably designed and can be arranged in the guided missile casing such that the position of the overall center of gravity remains essentially constant when a module is replaced. For example, the individual units can be designed such that movement is possible, in particular in the longitudinal direction, with respect to the guided missile casing and with respect to further units. It is also possible to choose the units for different, recurring operational scenarios overall such that, although they differ on a variant-specific basis in terms of their geometry and mass, they have a standard mass distribution and standard mass, however, when assembled to form the respectively required group.

Depending on the required mission, the sensor unit is preferably in the form of an electro-optical, infrared, radar or ladar seeker head which in particular is manufactured in a modular form. In this case, the seeker head may be both a rigid seeker head and a seeker head which can move with respect to the guided missile casing. The guided missile is thus able to detect and to fly to the target directly, depending on the choice of the appropriate sensor unit, or to carry out a predetermined target approach, by detection of terrain-specific characteristics. In particular, the sensor unit may also be equipped with GPS navigation, thus also allowing a satellite-based mission.

For mission termination on identification of a more important target or in the case of a misfire, the sensor unit is furthermore advantageously designed to be remotely controllable. A remote control capability such as this allows the guided missile to be steered manually to the target, in particular by an operator, or to be recovered in the case of mission termination.

In order to conceal the guided missile itself, it may be necessary to be possible to fly at low altitude throughout the entire mission. This is also necessary in order, for example, to attack a target which is concealed in gaps between buildings. If the guided missile is intended to operate at low altitudes over a relatively long time, a propulsion system is required which provides thrust throughout the entire flight time. The motor may need to be designed in order to achieve the required burning times.

Depending on the required mission and in particular as a function of the distance to be flown and the desired airspeed a turbine motor, a solid-fuel motor or a gel-fuel motor is advantageously provided as various variants of the propulsion unit. Particularly for a lightweight guided missile, a microturbine motor may be provided, as is known, for example, from model construction. Particularly for small missile dimensions, a so-called end-burner motor can be used as a solid-fuel motor.

The propulsion unit should preferably be arranged approximately centrally since the propulsion unit essentially governs the flying characteristics of the guided missile. This refinement furthermore offers the possibility of configuring the fuel reduction during flight such that this results in only an insignificant change to the overall center of gravity.

If a turbine motor is provided as the propulsion unit, then a fuel module which can be connected to the turbine motor is expediently provided, with the missile casing being designed to accommodate the fuel module close to the center of gravity. This means that the aerodynamics of the guided missile are not influenced by movement of the overall center of gravity as a result of the consumption of fuel during flight, with the fuel being taken from the fuel module arranged close to the center of gravity.

For an extremely lightweight guided missile, it is expedient for the motor structure of the solid-fuel motor to be formed from a fiber composite material, in particular from a plastic reinforced with carbon fibers. This makes it possible to considerably reduce the overall mass of the guided missile. As already mentioned, various payload units, both lethal and non-lethal payload units, can be provided for the guided missile. In particular, a shaped-charge unit or a so-called HPMW unit may be used as the payload unit. If the shaped-charge unit is arranged alongside the propulsion unit and thus alongside the sensor unit, then this results in the direction of action in the longitudinal direction of the guided missile being unrestricted. The High-Power-Micro-Wave unit can be used as an alternative, which can be used in particular to destroy electronic components at the target location by means of high-energy microwave radiation.

The missile casing is also preferably manufactured from a fiber composite material, in particular from a plastic reinforced with carbon fiber. This once again makes it possible to considerably reduce the overall mass of the guided missile. It also enhances its operational capability.

The components of the guided missile are optimized to achieve a high power-to-weight ratio by the choice of a fiber composite material. The breaking lengths and the specific stiffness of a material such as this are high. Carbon-fiber-reinforced plastics are particularly suitable in this case with regard to stiffness. Apart from this, a fiber composite material is preferred since the advantageous shaping characteristics also make it possible to produce complex geometries for the guided missile casing. If a fiber composite material is also used for the motor structure, then the motor and the guided missile overall have a desirable good-natured response in the case of a fire or bombardment. This so-called Insensitive Munition (IM) characteristic in particular very largely avoids chain reactions between munitions or weapons that are being stored.

Since the individual units of the guided missile are arranged within a missile casing, this can be designed to minimize a reflective cross section for electromagnetic radiation, in particular with regard to radar detection. In the case of a conventional guided missile, which is assembled from individual fuselage sections, such camouflage is not possible. In contrast, the missile casing designed in a standard form and which forms the outer casing of the guided missile is suitable for providing a camouflage characteristic such as this. By way of example, this is because the missile casing is formed by a number of facettes, in which case, although the facettes lead to reflection of incoming target detection radiation, reflected radiation in the direction of the transmitter emitting the target detection radiation is, however, avoided. In particular, flat geometries such as these should be avoided, with surfaces at an angle of about 90° to one another. Geometries such as these reflect arising radiation, on the principle of a "cat's eye" in the direction of the transmitter. In order to enhance the camouflage characteristics, the propulsion unit in particular is designed such that it is located essentially within the guided missile casing.

In order to increase the modularity and flexibility of the guided missile, the missile casing furthermore preferably has an accommodation area for accommodation of the units, which can be moved in the longitudinal direction. As mentioned, in one advantageous refinement, the missile is in the form of a so-called lightweight missile and has an overall mass of less than 70 kg, in particular of between 50 and 60 kg. In this case, in particular, the guided missile has an overall length of less than 2 m.

In order to further enhance the flexibility of the guided missile with regard to different operational scenarios and required missions, the guided missile casing is advantageously designed for attachment of wings which are manufactured in a modular form. It is possible to react flexibly to different required missions by different variants of the wings. In this case, the wings are expediently designed to be retractable.

Other features which are considered as characteristic for the invention are set forth in the appended claims.

Although the invention is illustrated and described herein as embodied in a guided missile, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
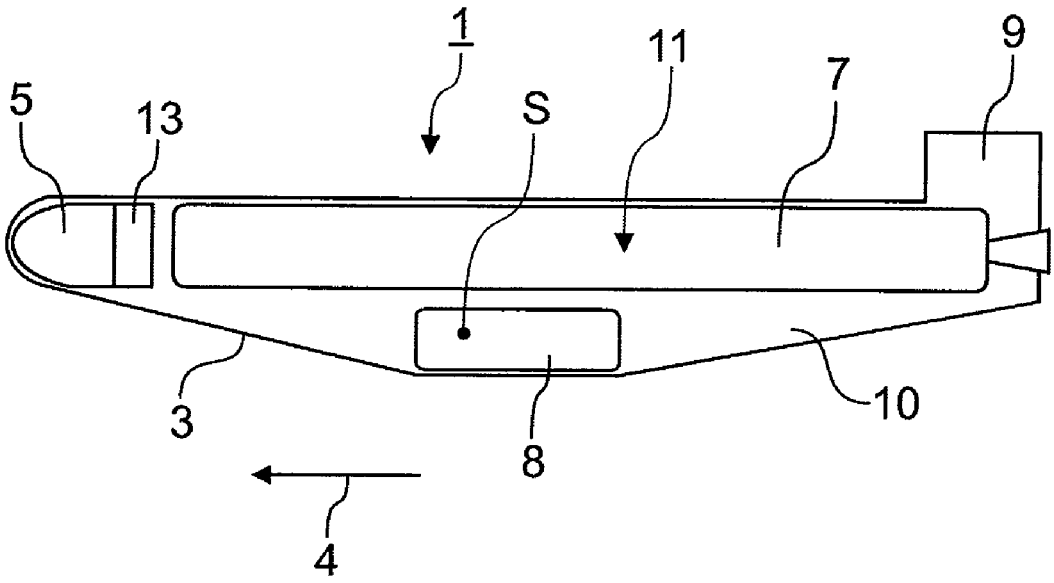
FIG. 1 is a schematic longitudinal section taken through a guided missile with a missile casing forming the outer contour.

Referring now to the figures of the drawing in detail and first, particularly, to FIG. 1 thereof, there is shown a schematic longitudinal section through a guided missile 1, which has a missile casing 3 that forms the outer contour. The missile casing 3, which is manufactured from a plastic reinforced with carbon fibers, extends along a longitudinal direction 4 and is designed to accommodate a sensor unit 5, a propulsion unit 7 and a payload unit 8. The individual units 5, 7 and 8 are each manufactured in a modular form in operation-specific variants, and have standard interfaces for rapid replacement within the missile casing 3. Control surfaces 9 are located at the tail end of the guided missile 1, for flight stabilization, and are in the form of a part of the missile casing 3.

The sensor unit 5 is disposed in the nose of the guided missile 1 and is in the form of an infrared seeker head, which is designed such that it can move with respect to the missile casing 3. By way of example, an infrared seeker head such as this can be used to identify a specific terrain form, and as a result to keep the guided missile 1 on a desired target approach.

The propulsion unit 7, which is arranged in an accommodation area 10 in the interior of the missile casing 3, is in the form of a solid-fuel motor 11, in particular a so-called end burner. The integration of the propulsion unit 7 in the interior of the missile casing 3 avoids surfaces which reflect radiation efficiently and, for example, lead to an increase in the identifiable radar cross section. The missile casing 3 is designed overall to minimize the radar reflection cross section.

The propulsion unit 7 and the payload unit 8 are arranged alongside one another with respect to the longitudinal direction 4 in the accommodation area 10. The payload unit 8 is, in the present case, in the form of a shaped charge, by way of example. The free active direction, pointing forwards, for the shaped charge can be seen. In comparison to a conventional guided missile, there is no need first of all to penetrate the sensor system 5.

As can be seen, the arrangement of the payload unit 8 alongside the propulsion unit 7 allows geometry and mass variation of both units without changing the overall center of gravity S of the guided missile 1. For example, the geometry of the payload unit 8 can be varied symmetrically in the longitudinal direction 4 with respect to the overall center of gravity. The individual center of gravity, for example of the payload unit 8, can also be moved back, compensated for by an appropriate movement in the opposite direction of the individual center of gravity of the propulsion unit 7. This also applies to the individual masses.

With regard to variant-specific refinements of the individual units, the illustrated guided missile 1 is considerably more flexible than conventional guided missiles with individual fuselage sections. The guided missile 1 can be specifically matched to different operational scenarios or required missions by appropriate choice of the desired variants of the individual units.

Furthermore, the sensor unit 5 has a remote-control module 13 which allows the guided missile 1 to be operated on a user-specific basis.

Figure 2:
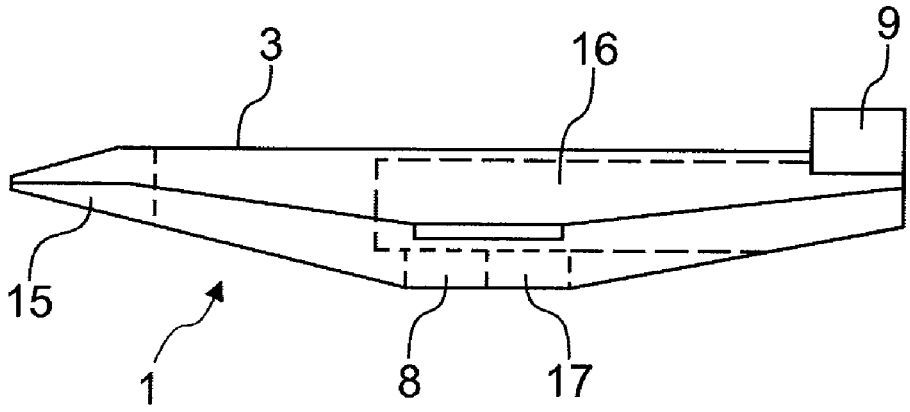
FIG. 2 shows, schematically, and in the form of a partially transparent illustration, an alternative refinement of a guided missile as shown in FIG. 1.

FIG. 2 shows a guided missile 1', which is somewhat modified in comparison with the missile assembly shown in FIG. 1. FIG. 2 is in the form of a partially transparent illustration. In comparison to the guided missile 1 shown in FIG. 1, the guided missile 1' now has a rigid seeker head 15 at its nose as the sensor unit 5. By way of example, this is in the form of a radar seeker head and is used for direct target approach. Instead of the solid-fuel motor 11 shown in FIG. 1, a turbine motor 16 which comprises two microturbines, as known from model construction, is inserted into the missile 1'. The guided missile 1' is thus designed for a relatively long operational flight at low speed and at a low flying altitude. As the payload unit 8, the guided missile 1' is fitted with an HPMW unit, whose aim is to non-lethally destroy electronic components at the target location (HPMW=high power microwave). Furthermore, a fuel module 17, which provides the fuel supply for the turbine motor 16, is fitted approximately in the vicinity of the overall center of gravity. Since the fuel module 17 is arranged approximately in the vicinity of the overall center of gravity of the guided missile 1', the overall center of gravity of the guided missile 1' does not change, or only changes insignificantly, while fuel is being consumed during flight.

The missile casings of the guided missile 1 and of the guided missile 1' are identical.

Figure 3:
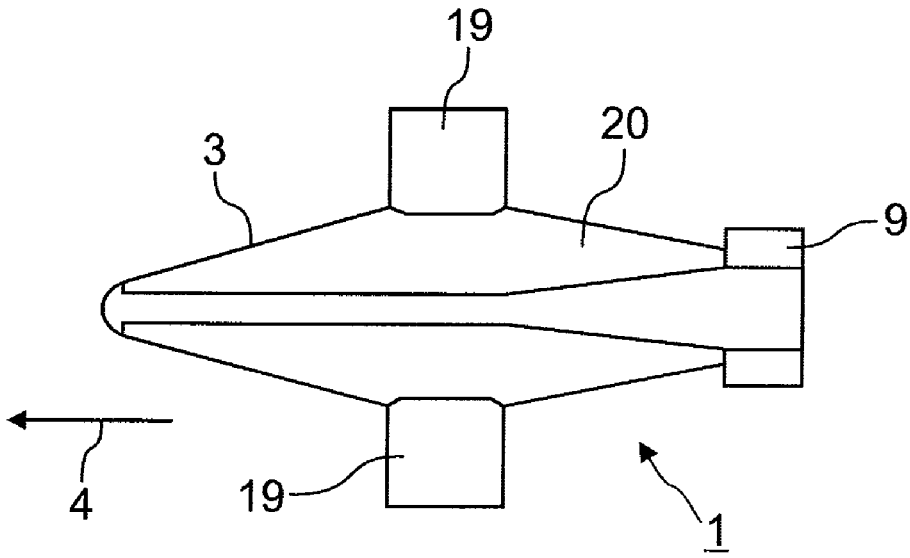
FIG. 3 is a plan view of the guided missile shown in FIG. 1.

FIG. 3 shows a plan view of the guided missile 1, for example as shown in FIG. 1. As can now be seen, wings 19 are inserted into the missile casing 3 in order to improve the flying characteristics of the guided missile 1. Once again, the control surfaces 9 can be seen at the end of the guided missile 1.

As can also be seen, the missile casing 3 is designed to minimize the radar reflection cross section. For this purpose, the missile casing 3 is designed with a complex geometry overall and, in detail, has individual facettes 20 which admittedly reflect incoming target detection radiation but which largely avoid reflection back to the transmitter. In particular, this facette-like configuration avoids surfaces which are at an angle of about 90° to one another.

Since the missile casing 3 is manufactured from a plastic reinforced with carbon fiber, it is extremely lightweight and can be ignited only with difficulty, even in the event of a fire or bombardment.

Figure 4:
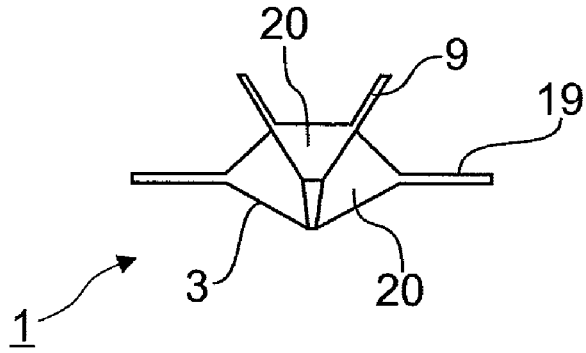
FIG. 4 is a front view of the guided missile shown in FIG. 1.

FIG. 4 shows a front view of the guided missile 1 shown in FIG. 1. As can now be seen, the control surfaces 9 are formed by two fins which are at an angle to one another and are manufactured as part of the missile casing 3. The figure also shows the wings 19 and the individual facettes 20 of the missile casing 3.

The invention claimed is:

1. A guided missile, comprising:

a missile casing defining an outer contour of the missile and extending along a longitudinal direction;

a plurality of units accommodated in said missile casing, said units including a sensor unit, a propulsion unit, and a payload unit;

wherein said missile casing is configured to accommodate at least two of said units fitted alongside one another in the longitudinal direction.

2. The guided missile according to claim 1, wherein said propulsion unit and said payload unit are fitted alongside one another in said missile casing.

3. The guided missile according to claim 1, wherein said payload unit is disposed at an overall center of gravity of the missile.

4. The guided missile according to claim 1, wherein at least one of said units is an interchangeable module.

5. The guided missile according to claim 4, wherein said interchangeable module is configured for placement in said missile casing such that a position of the overall center of gravity remains substantially constant when a module is replaced.

6. The guided missile according to claim 1, wherein said sensor unit is an electro-optical, infrared, radar or ladar seeker head.

7. The guided missile according to claim 6, wherein said sensor unit is manufactured in modular form.

8. The guided missile according to claim 1, wherein said sensor unit comprises GPS navigation.

9. The guided missile according to claim 1, wherein said sensor unit is a remotely controllable unit.

10. The guided missile according to claim 1, wherein said propulsion unit is a turbine motor, a solid-fuel motor, or a gel-fuel motor.

11. The guided missile according to claim 10, wherein said propulsion unit is manufactured in modular form.

12. The guided missile according to claim 10, wherein said motor is a solid-fuel motor having a motor structure formed from a fiber composite material.

13. The guided missile according to claim 10, wherein said motor structure of said solid-fuel motor is formed of a plastic reinforced with carbon fibers.

14. The guided missile according to claim 1, wherein said propulsion unit is disposed substantially centrally within said missile casing.

15. The guided missile according to claim 1, wherein said propulsion unit is a turbine motor, and a fuel module is connected to said turbine motor, and said missile casing is configured to accommodate said fuel module substantially close to a center of gravity of the missile.

16. The guided missile according to claim 1, wherein said payload unit is a shape-charged unit or an HPMW unit.

17. The guided missile according to claim 16, wherein said payload unit is manufactured in modular form.

18. The guided missile according to claim 1, wherein said missile casing is manufactured from a fiber composite material.

19. The guided missile according to claim 18, wherein said missile casing is formed of a plastic reinforced with carbon fiber.

20. The guided missile according to claim 1, wherein said missile casing is configured to minimize a reflective cross section for electromagnetic radiation.

21. The guided missile according to claim 20, wherein said missile casing is configured to minimize a reflective cross section with regard to radar detection.

22. The guided missile according to claim 1, wherein said missile casing is formed with an accommodation area for accommodation of said units, and wherein said accommodation area is movably disposed in the longitudinal direction.

23. The guided missile according to claim 1, formed to have an overall mass of less than 70 kg.

24. The guided missile according to claim 23, formed to have an overall mass between 50 and 60 kg.

25. The guided missile according to claim 1, wherein said missile casing is configured for the attachment of wings manufactured in a modular form.

26. The guided missile according to claim 25, wherein said wings are retractable wings.

* * * * *